US007518569B1

(12) United States Patent
Conrad

(10) Patent No.: US 7,518,569 B1
(45) Date of Patent: Apr. 14, 2009

(54) STABILIZING MECHANISM FOR A DEPLOYED REFLECTOR ANTENNA IN A MOBILE SATELLITE ANTENNA SYSTEM AND METHOD

(75) Inventor: Timothy John Conrad, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 74 days.

(21) Appl. No.: 11/863,570

(22) Filed: Sep. 28, 2007

(51) Int. Cl.
*H01Q 3/02* (2006.01)
*H01Q 1/08* (2006.01)

(52) U.S. Cl. ..... 343/882; 343/713; 343/878; 343/840

(58) Field of Classification Search ..... 343/711, 343/713, 761, 878, 882, 840, 915
See application file for complete search history.

(56) References Cited

U.S. PATENT DOCUMENTS

| | | | | | |
|---|---|---|---|---|---|
| 3,546,704 | A | * | 12/1970 | Selby et al. | 343/765 |
| 4,811,026 | A | * | 3/1989 | Bissett | 343/766 |
| 5,337,062 | A | | 8/1994 | Sherwood et al. | |
| 5,418,542 | A | | 5/1995 | Sherwood et al. | |
| 5,515,065 | A | * | 5/1996 | Sherwood et al. | 343/882 |
| 5,528,250 | A | | 6/1996 | Sherwood et al. | |
| 5,554,998 | A | * | 9/1996 | Sherwood et al. | 343/881 |
| 5,646,638 | A | | 7/1997 | Winegard et al. | |
| 5,929,817 | A | * | 7/1999 | Clark | 343/713 |
| 6,023,247 | A | | 2/2000 | Rodeffer | |
| 6,047,928 | A | * | 4/2000 | Benoliel et al. | 244/172.9 |
| 6,188,300 | B1 | | 2/2001 | Rodeffer | |
| 6,466,179 | B1 | * | 10/2002 | Ehrenberg et al. | 343/840 |
| 7,230,581 | B2 | | 6/2007 | McEwan | |
| 7,397,435 | B2 | * | 7/2008 | McEwan | 343/713 |
| 2006/0038728 | A1 | | 2/2006 | McEwan | |
| 2007/0013604 | A1 | | 1/2007 | McEwan | |

OTHER PUBLICATIONS

Gas Springs [online], [retrieved on Sep. 24, 2007]. Retrieved from the McMaster-Carr Catalog using Internet <URL: http://www.mcmaster.com/nav/enter.asp?pagetype=srchctlg&search=gas+spring &typ=mg&srchCompleteInd=True &sesnextrep=327312112031962&newFrmWkldd=false &RegTyp=CATALOG&CtlgPgNbr=1137 &RelatedCtlgPgs=1137,1138,1139,1140,1141,1142 &term=Gas%2bSprings>.

* cited by examiner

*Primary Examiner*—Douglas W. Owens
*Assistant Examiner*—Chuc Tran
(74) *Attorney, Agent, or Firm*—Dorr, Carson & Birney, P.C.

(57) ABSTRACT

A stabilizing mechanism and method for a deployed reflector antenna in a mobile satellite system. The stabilizing mechanism has a pair of stabilizing devices with a first end of each stabilizing device connected on a rear support of the reflector antenna. The first ends are positioned on opposite sides of the rear support. A second end of each stabilizing device is connected to a tilt mechanism in the mobile satellite system. The pair of stabilizing devices forms a support angle about the centerline of the reflector antenna and with the tilt mechanism. The pair of stabilizer devices pushes against the opposite sides with a pre-load force when the reflector antenna is deployed to minimize deflection of the reflector antenna due to environmental forces.

21 Claims, 5 Drawing Sheets

110
20
10
90
102
100
72
70
110
120
80
104
60
50
30
40

Fig. 5
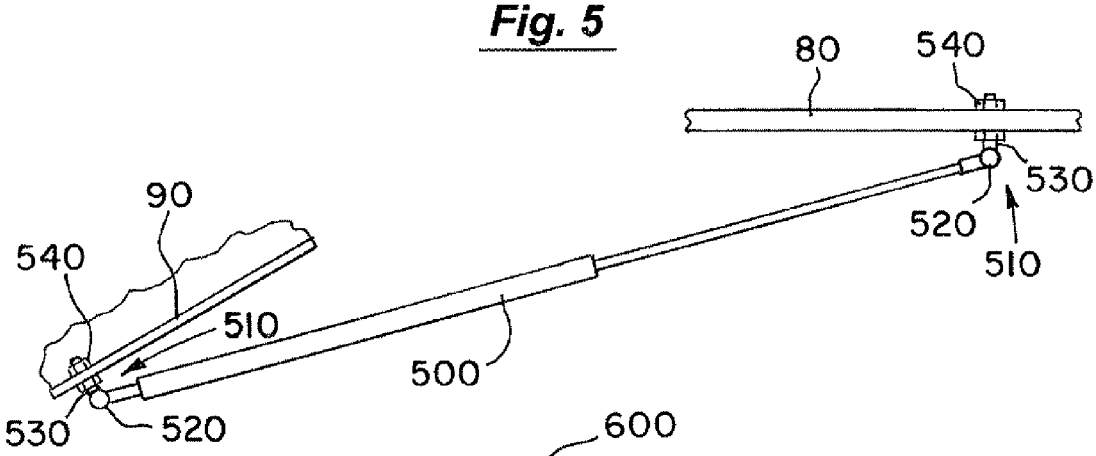
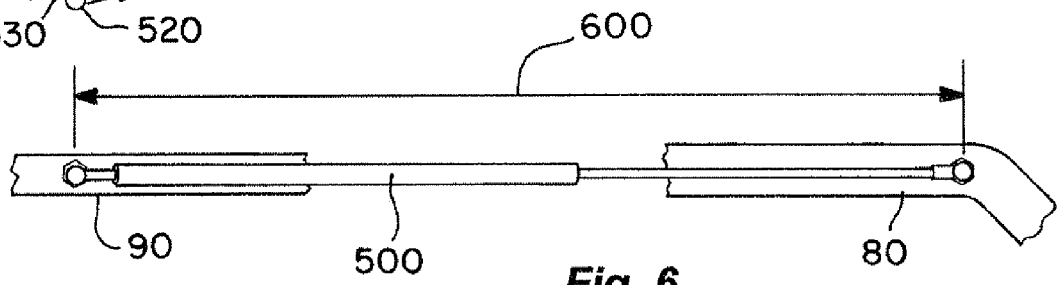
Fig. 6
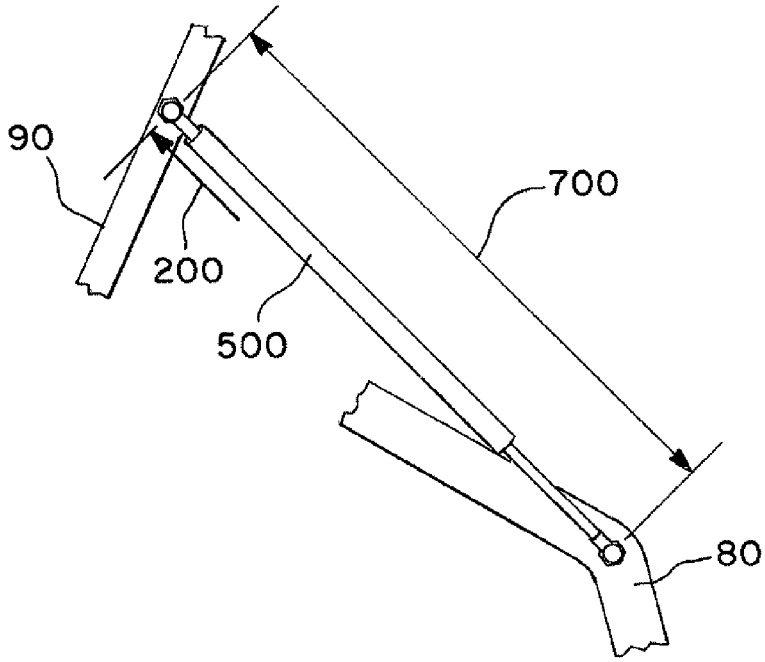
Fig. 7

STABILIZING MECHANISM FOR A DEPLOYED REFLECTOR ANTENNA IN A MOBILE SATELLITE ANTENNA SYSTEM AND METHOD

BACKGROUND OF THE INVENTION

1. Field of the Invention

The invention relates to the field of mobile satellite antenna systems and, more particularly, to mechanisms and methods stabilizing deployed reflector antennas in mobile satellite systems during use to maintain communication with a target satellite under adverse environmental conditions.

2. Discussion of the Background

Mobile satellite systems, mounted on a wide variety of vehicles, are used worldwide to provide two-way satellite communications such as, for example, broadband data, video conferencing and other corporate communications for diverse uses as found in oil and gas, construction, military, mobile education, emergency medical and service providers, and news organizations. These systems need to be rugged and reliable and are often subject to use in severe weather environments. A mobile satellite system deploys a reflector antenna and automatically targets it on a satellite in orbit at a desired location. When not in use or in transit, the reflector antenna is stowed, usually in a low profile design, close to a transport surface such as the top of a vehicle.

The reflector antennas in such mobile satellite systems are large such as 1.2 meter in size. Such large reflectors when deployed may be subject to severe weather that can deflect the satellite antenna off the target satellite resulting in communication loss. A need exists to minimize such deflection when the reflector antenna is deployed due to high wind, heavy snow and/or ice loads.

SUMMARY OF THE INVENTION

A stabilizing mechanism and method for a deployed reflector antenna in a mobile satellite system substantially minimizes deflection during adverse environmental forces.

The stabilizing mechanism has a pair of stabilizing devices such as gas springs. A first end of each stabilizing device is connected on a rear support of the reflector antenna. The first ends are connected and positioned on opposite sides of the rear support, such as a dish adaptor. A second end of each stabilizing device is connected to a tilt mechanism, such as parallel tilt links, in the mobile satellite system. The pair of stabilizing devices form a support angle with the centerline of the reflector antenna. The pair of stabilizer devices pushes against the opposite sides with a pre-load force when the reflector antenna is deployed in the mobile satellite system to minimize deflection of the reflector antenna due to environmental forces.

A method of stabilizing a reflector antenna in a mobile satellite antenna system applies a force against opposing sides on the rear of the reflector antenna as the reflector antenna is deployed in the satellite mobile system. The applied force increases as the reflector antenna deploys. When the reflector is fully deployed, the force applied is the greatest to minimize deflection of the reflector antenna in the presence of environmental forces.

BRIEF DESCRIPTION OF THE DRAWINGS

FIG. 5 is a top view illustration of the stabilizing device of the present invention in an extended stowed position.

FIG. 6 is a side view illustration of the stabilizing device of the present invention in an extended stowed position shown in FIG. 5.

FIG. 7 is a side view illustration of the stabilizing device of the present invention in a compressed deployed position.

DETAILED DESCRIPTION OF THE INVENTION

Figure 1:
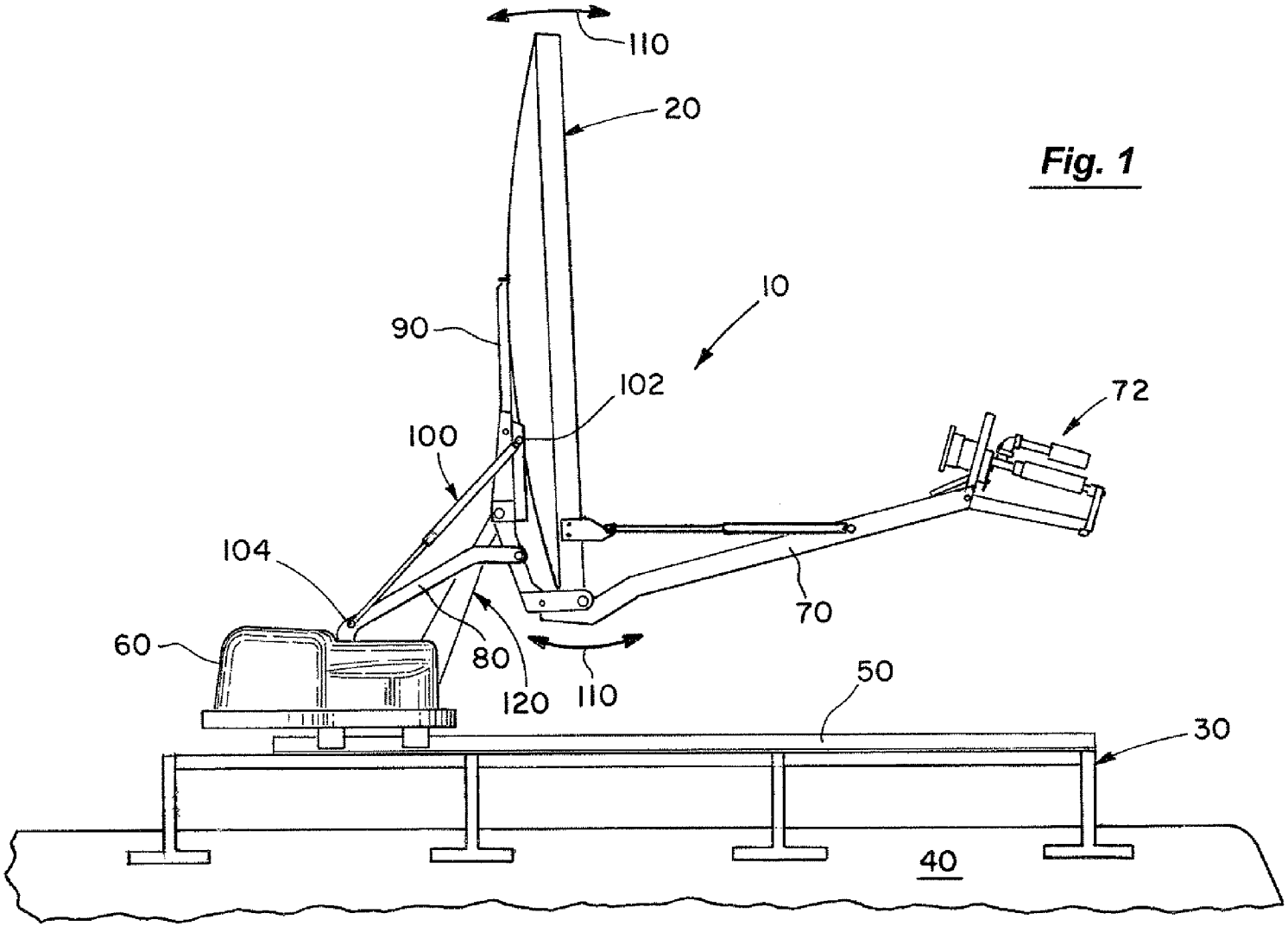
FIG. 1 is a side view of a satellite mobile antenna system having the stabilizing mechanism of the present invention.

In FIG. 1, the mobile satellite system 10 of the present invention is shown, with the reflector antenna 20 moving (as shown by arrows 110) between a deployed position and a stowed position. The mobile satellite system 10 is shown mounted on support 30 of a vehicle 40. The mobile satellite system 10 of FIGS. 1 through 4 has a track 50, a housing 60 containing motors, gears, controls (not shown), and a feed support arm 70 carrying a feed 72. A tilt mechanism 80 (such as tilt links 80A, 80B) tilts the reflector antenna 20 as it is lifted by a lift mechanism 120 to deploy. The tilt mechanism 80 is part of the lift mechanism 120. The mobile satellite system 10 of the present invention is of the type found in U.S. Pat. No. 7,230,581 and incorporated herein by reference. The details of the support 30, the housing 60, the track 10, the feed arm 70 and the feed 72 are not necessary to practice the teachings of the various embodiments of the present invention. Nor, is the present invention limited to use on the mobile satellite system 10 shown in FIGS. 1-4.

The stabilizing mechanism 100 of the present invention uses a pair of stabilizing devices 100A and 100B to minimize deflection (as shown generally by arrows 120 in FIG. 3) of the reflector antenna 20 when deployed, in use, and subject to harsh environmental conditions such as wind. The forces causing the deflection can impact the reflector antenna 20 from any direction and with any force to cause deflection 120 to occur in any direction. Each stabilizing device 100A, 100B, in one embodiment, is a steel gas spring for use in harsh environments. The design of a specific gas spring is dependent on the size of the reflector antenna 20 being stabilized. By way of example, for a 1.2 meter reflector antenna 20, a gas spring 100A, 100B operable under the teachings of the present invention has: when stowed—length of about 31 inches; when fully deployed—a compressed length of about 17 inches; and an available force of about 50 pounds. The stabilizing mechanism 100 of the present invention finds application on reflector antennas 20 that are 0.96 meters and larger.

For a given reflector antenna, any suitable gas spring could be utilized under the teachings of the present invention. By way of illustration, for the above example, the gas springs 100A, 100B would be in an extended position when the reflector antenna is stowed and in a compressed position when deployed. While springs 100A, 100B, such as gas springs, constitute one embodiment of the present invention, the present invention is not so limited. Any suitable gas spring, piston or spring can be used.

Figure 2:
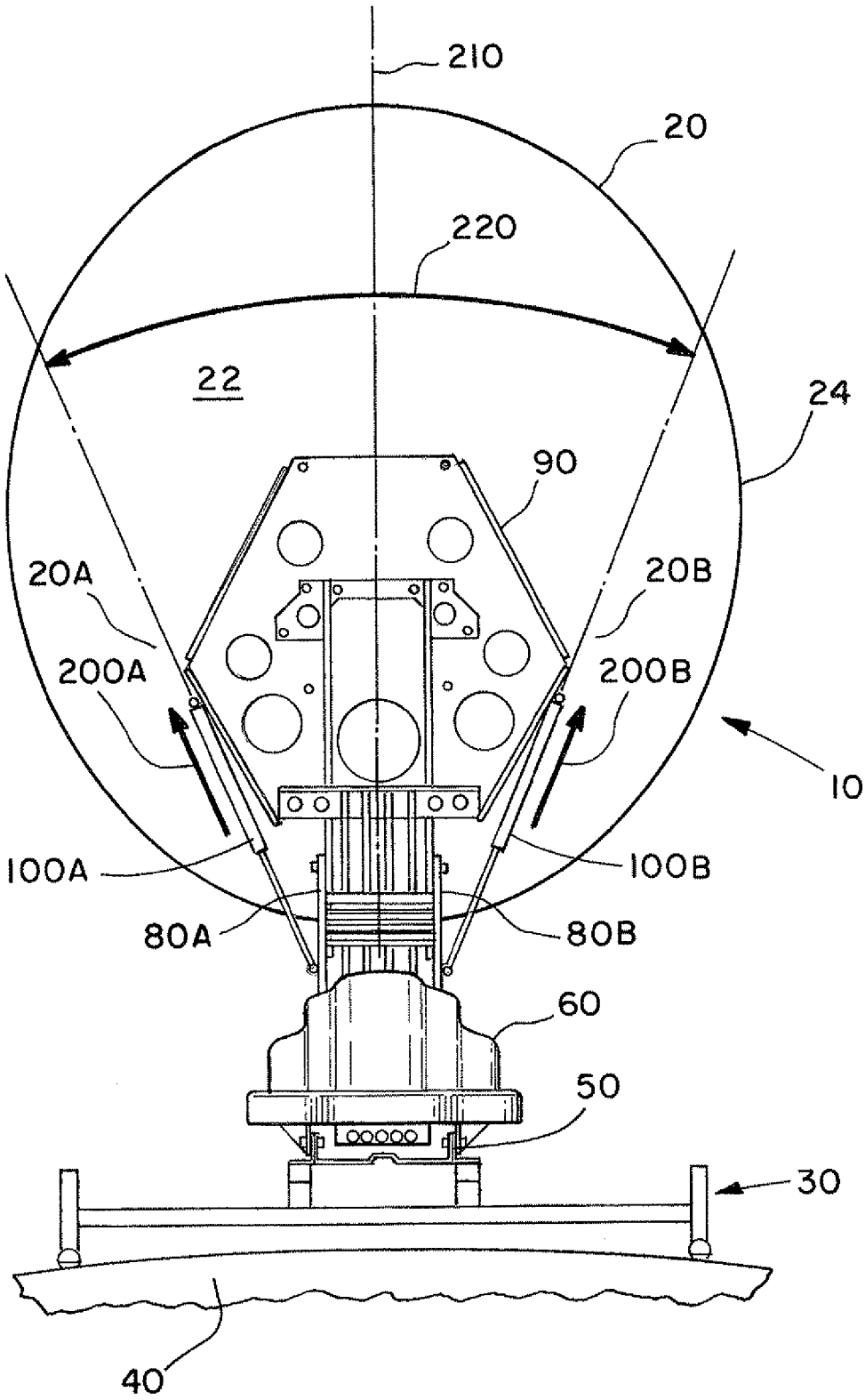
FIG. 2 is an end view of a satellite mobile antenna system having the stabilizing mechanism of the present invention.
Figure 3:
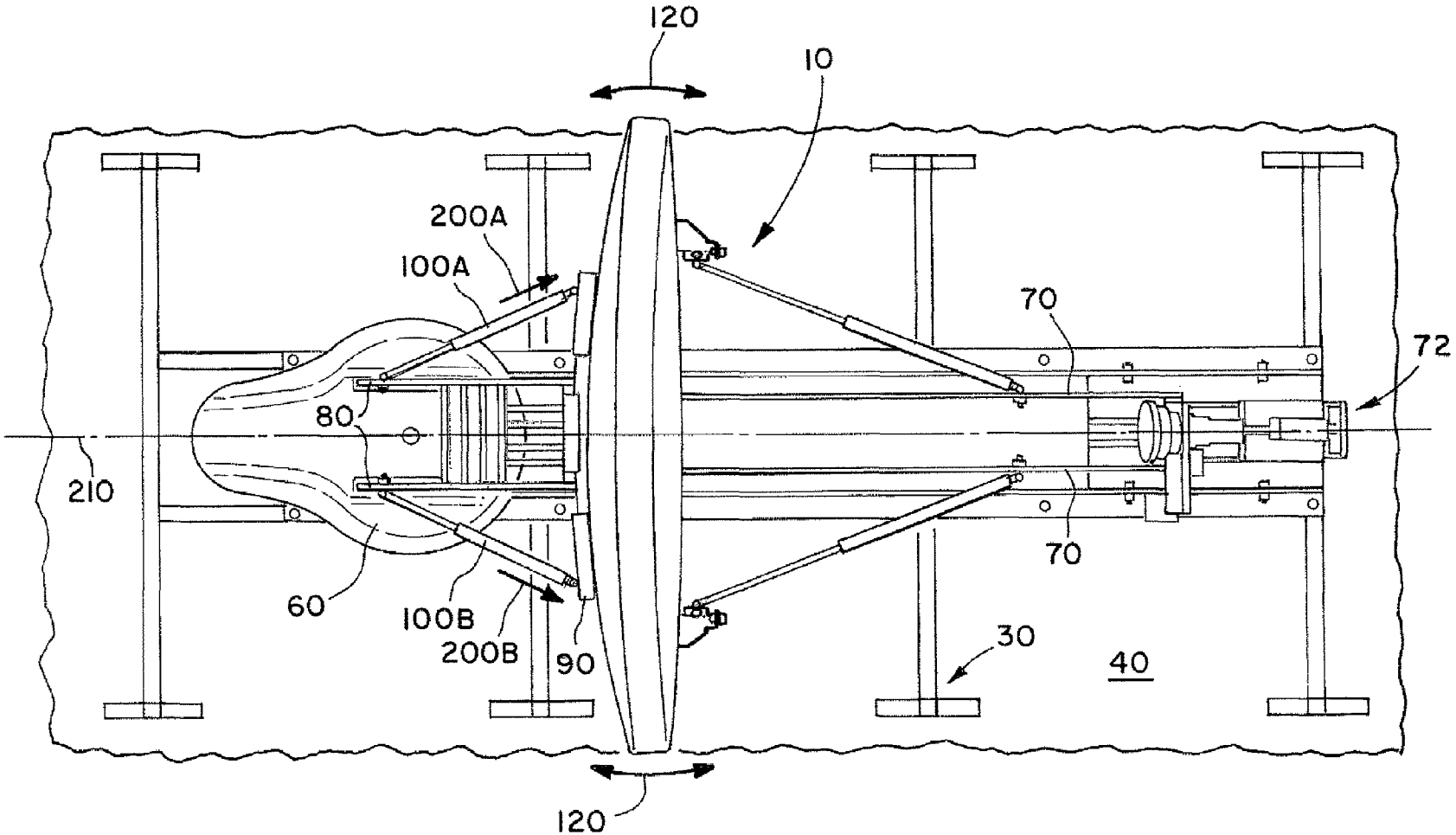
FIG. 3 is a top view of a satellite mobile antenna system having the stabilizing mechanism of the present invention.
Figure 4:
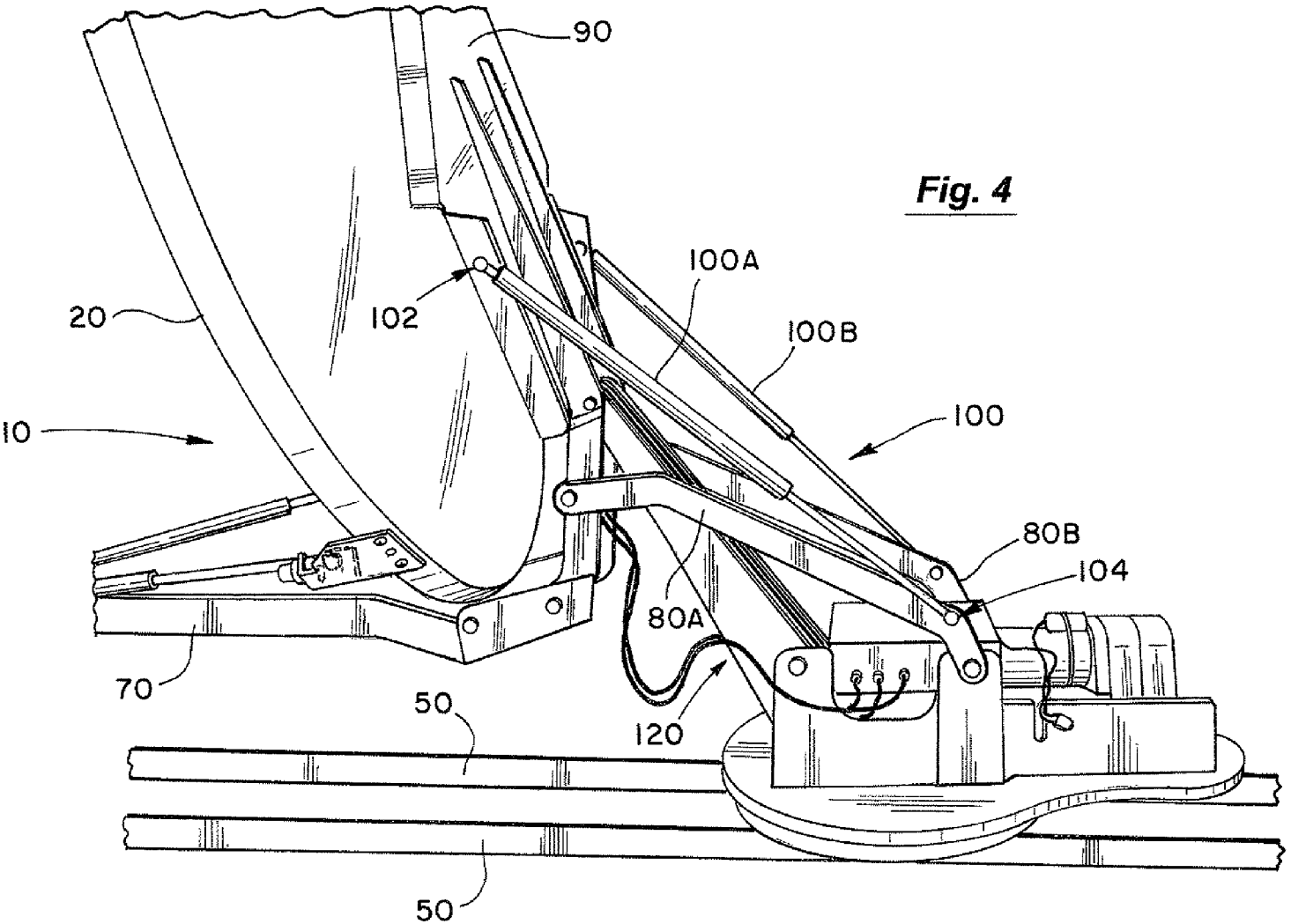
FIG. 4 is a partial perspective view of a satellite mobile antenna system having the stabilizing mechanism of the present invention.

Each stabilizing device 100A, 100B is connected between a tilt link 80 (best shown in FIG. 1) and a dish adapter 90 (as best shown in FIG. 2). The conventional dish adapter 90 is firmly attached to (or integral with) the back 22 of the reflector antenna 20 in a conventional fashion to provide rigid support to lift and to lower the reflector antenna 20. Most satellite mobile systems use a dish adaptor 90 to attaché the reflector antenna 20 to the system 10 The dish adaptor 90 provides structural rear support at the back 22 of the reflector antenna 20 and is connected by means of suitable connectors such as screws (not shown). The shape of the adaptor is shown to be hexagonal, but can be any suitable shape such as a square, circle, or rectangle. In some mobile satellite systems the reflector antenna 20 may have an integral rear support which corresponds to the dish adaptor 90. The parallel tilt links 80 are used to conventionally tilt the reflector antenna 20 during deployment and satellite acquisition. The design of dish adaptors 90 vary in different satellite mobile systems. Likewise, the design of the tilt mechanism 80 as part of the lift mechanism 120 varies among different satellite mobile systems. In another embodiment the stabilizing mechanism 100 of the present invention is operative with the lift mechanism 120. It is to be understood that the stabilizing devices 100A, 100B are not limited to use with the parallel tilt links 80A, 80B shown. By way of illustration if there is one tilt link or one lift mechanism, the stabilizing devices 100A, 100B are connected to opposite sides thereof or even at a common point thereon.

The stabilizing mechanism 100 is designed, as the reflector antenna 20 deploys, to provide two increasing forces (as shown by arrows 200 in FIG. 2) pushing on opposite sides 20A, 20B of the reflector antenna 20 through the back of the dish adaptor 90 to make the satellite antenna 20 more rigid which substantially minimize deflection 120. In one embodiment, the stabilizing devices are connected to the rim 24 at the back of a sturdy reflector antenna 20 in a manner so as not to cause skew.

As shown if FIG. 2, a centerline 210 exists through the reflector antenna 20 and the dish adaptor 90 between the tilt links 80 as the reflector antenna 20 is deployed and acquires a target satellite. Each stabilizing device 100A, 100B forms a support angle 220 with centerline 210. The centerline 220 is through the reflector antenna 20 and the mobile satellite system 10 as it is mounted 30 on a vehicle 40. The support angle 220 varies as the reflector antenna 20 deploys. The varying angle is further a function of the specific design of the mobile satellite system 10. The angle 220 provides stabilization against deflection (as generally shown by arrows 120 in FIG. 3) to the deployed reflector antenna 20 especially in harsh environmental forces impacting on the deployed system 10.

The stabilizing mechanism 100 of the present invention provides stabilization against deflection 120 and other angular deflections that may be present.

In FIGS. 5 through 7, the details of using a gas spring 500 as a stabilizing device 100A, 100B are set forth. Conventional gas springs 500, as shown in FIG. 5, can have a ball-Joint fitting 510 with a ball socket 520 and a ball stud 530 that allows rotation to compensate for direction changes between deployment and stowing. A conventional lock nut 540 is used to firmly connect the ball-joint fitting 510 to either the dish adaptor 90 or to the tilt link 80.

In FIGS. 5 and 6, the gas spring 500 is fully extended having a length of 600 (such as in a fully stowed position). In FIG. 7, the gas spring 500 is fully compressed having a length of 700 (such as in a fully deployed position). As shown in FIG. 7, the force 200 from compression of the gas spring 500 is greatest when the reflector antenna is in the position of maximum deployment. The force 200 increases against the dish adaptor 90 as the reflector antenna 20 moves from a stowed position to a deployed position. The pair of forces 200A, 200B (see FIG. 2) provided by the stabilizing mechanism 100 of the present invention provide pre-loading of the back of the reflector antenna, not only as the antenna deploys, but increasing to the highest pre-loading force for that satellite acquisition. Depending on the position of the vehicle in relation to the position of the satellite, the pre-load force at satellite acquisition will vary.

In summary, the stabilizing mechanism 100 of the present invention substantially minimizes deflection 120 of a deployed reflector antenna 20 in a mobile satellite system 10 undergoing environmental forces such as wind. The stabilizing mechanism 100 uses a pair of stabilizing devices 100A, 100B such as gas springs 500. A first end 102 of each stabilizing device 100A, 100B is connected on a rear support 90 (that is a separate structure such as a dish adaptor or the rear of the reflector antenna such as at or near rim 24 or elsewhere) of the reflector antenna 20. The first ends 102 are connected and positioned on opposite sides 20A, 20B of the rear support 90 of the reflector antenna 20. A second end 104 of each stabilizing device 100A, 100B is connected to a tilt mechanism 80 in the mobile satellite system 20. The pair of stabilizing devices 100A, 100B forms a support angle about the centerline 210 of the reflector antenna 20 and with the tilt mechanism 80. The pair of stabilizer devices 100A, 100B pushes 200 against the opposite sides 20A, 20B with a preload force when the reflector antenna 20 is deployed in the mobile satellite system 10 to minimize deflection of the reflector antenna 20 due to environmental forces.

A method of stabilizing a reflector antenna in a mobile satellite antenna system is also set forth above. The stabilizing mechanism 100 applies a force against opposing sides 20A, 20B on the rear of the reflector antenna 20 as the reflector antenna 20 is deployed in the satellite mobile system 10. Each gas spring 500, as the reflector antenna deploys further, increases the force 200 applied due to compression of the gas spring 500. While the present invention uses a stabilizing device 100 that pushes against the back 90 of the reflector antenna 20, it is to be understood that a pulling force 200 could also be used. When the reflector antenna 20 is fully deployed and targeted on a satellite, the force 200 applied is the greatest to minimize deflection of the reflector antenna in the presence of environmental forces. That is, the force is the greatest for that deployed target position. For any deployment of the reflector antenna 20, the force applied 200 increases until deploying stops at a desired satellite and for that target satellite; the final applied force is greatest.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A stabilizing mechanism for a deployed reflector antenna in a mobile satellite system, the mobile satellite system having a lift mechanism for deploying and stowing the reflector antenna, the reflector antenna having a rear support, the stabilizing mechanism comprising:

a pair of stabilizing devices;

a first end of each stabilizing device in said pair connected on said rear support of said reflector antenna, said first ends of said pair positioned on opposite sides of said rear support of said reflector antenna;

a second end of each stabilizing device in said pair connected to said lift mechanism, said pair of stabilizing devices forming a support angle about the centerline of said reflector antenna;

said pair of stabilizer devices pushing against said opposite sides with a pre-load force when said reflector antenna is deployed in said mobile satellite system to minimize deflection of said reflector antenna due to environmental forces.

2. The stabilizing mechanism of claim 1 wherein said lift mechanism further comprises a tilt mechanism and wherein said second end is connected to said tilt mechanism.

3. The stabilizing mechanism of claim 2 where in said tilt mechanism comprises a pair of parallel tilt links.

4. The stabilizing mechanism of claim 1 wherein said rear support is located at a rim of said reflector antenna.

5. The stabilizing mechanism of claim 1 wherein the pair of stabilizing devices is a pair of gas springs.

6. The stabilizing mechanism of claim 5 wherein said first end of each gas spring further comprises a ball-joint fitting connected to said rear support.

7. The stabilizing mechanism of claim 5 wherein said second end of each gas spring further comprises a ball-joint fitting connect to said lift mechanism.

8. The stabilizing mechanism of claim 5 wherein said pre-load force is a compressive force produced by said pair of gas springs under going compression as the reflector antenna is deployed.

9. The stabilizing mechanism of claim 1 wherein the rear support of the reflector antenna further comprises a dish adaptor, said dish adaptor attached to said reflector antenna.

10. The stabilizing mechanism of claim 1 wherein the tilt mechanism comprises parallel tilt links, one of said second end of said pair of stabilizing devices connected to one of said parallel links.

11. A stabilizing mechanism for a deployed reflector antenna in a mobile satellite system, the mobile satellite system having a tilt mechanism for deploying and stowing the reflector antenna, the reflector having a dish adaptor connected to said tilt mechanism, the stabilizing mechanism comprising:

a pair of springs;

a first end of each spring in said pair pivotally connected on said dish adaptor of said reflector antenna, said first ends of said pair positioned on opposite sides of said dish adaptor;

a second end of each spring in said pair pivotally connected to said tilt mechanism;

said pair of springs pushing against said opposite sides of said dish adaptor with a pre-load force when said reflector antenna is deployed in said mobile satellite system to minimize deflection of said reflector antenna due to environmental forces.

12. The stabilizing mechanism of claim 11 wherein said pair of springs is a pair of gas springs.

13. The stabilizing mechanism of claim 11 wherein said first end of each spring further comprises a ball-joint fitting connected to said dish adaptor.

14. The stabilizing mechanism of claim 11 wherein said second end of each spring further comprises a ball-joint fitting connected to said tilt mechanism.

15. The stabilizing mechanism of claim 11 wherein said pre-load force is a compressive force produced by said pair of springs under going compression as the reflector antenna is deployed.

16. The stabilizing mechanism of claim 11 wherein the tilt mechanism comprises parallel tilt links, each said second end of said pair of stabilizing devices connected to one of said parallel links.

17. A stabilizing mechanism for a deployed reflector antenna in a mobile satellite system, the mobile satellite system having a pair of parallel tilt links for deploying and stowing the reflector antenna, the reflector having a dish adaptor connected to said pair of parallel tilt links, the stabilizing mechanism comprising:

a pair of gas springs;

a first end of each gas spring in said pair connected on said dish adaptor of said reflector antenna, said first ends of said pair positioned on opposite sides of said dish adaptor;

a second end of each gas spring in said pair pivotally connected to one of said parallel tilt links;

said pair of gas springs pushing against said opposite sides of said rear support with a pre-load force when said reflector antenna is deployed in said mobile satellite system to minimize deflection of said reflector antenna due to environmental forces.

18. The stabilizing mechanism of claim 17 wherein said first end of each gas spring further comprises a ball-joint fitting connected to said dish adaptor.

19. The stabilizing mechanism of claim 17 wherein said second end of each gas spring further comprises a ball-joint fitting connected to said parallel tilt links.

20. A method of stabilizing a reflector antenna in a mobile satellite antenna system, said method comprising:

applying a force against opposing sides on the rear of the reflector antenna as the reflector antenna is deployed in the satellite mobile system;

increasing the force applied as the reflector antenna deploys;

when the reflector is fully deployed, the force applied being the greatest to minimize deflection of the reflector antenna in the presence of environmental forces.

21. The method of claim 20 wherein applying a force comprising pushing against the opposing sides with a compressed gas spring connected to the rear of the reflector.

* * * * *